US005178598A

United States Patent [19]

Finch

[11] Patent Number: 5,178,598

[45] Date of Patent: Jan. 12, 1993

[54] EXERCISER FOR SOFTBALL PITCHERS

[76] Inventor: Douglas W. Finch, 15770 Lomela Ct., La Mirada, Calif. 90638

[21] Appl. No.: 894,954

[22] Filed: Jun. 8, 1992

[51] Int. Cl.[5] ..... A63B 69/40

[52] U.S. Cl. ..... 482/118; 273/26 R; 273/189 R

[58] Field of Search ..... 482/118, 91, 111, 20, 482/114, 115, 117, 119, 120; 273/26 R, 26 E, 29 A, 183 B, 184 B, 189 R

[56] References Cited

U.S. PATENT DOCUMENTS 3,738,661 6/1973 Moller ..... 482/118
4,592,545 6/1986 Sagedahl et al. ..... 482/7
5,018,729 5/1991 Wilkerson ..... 273/29 A

*Primary Examiner*—Stephen R. Crow
*Attorney, Agent, or Firm*—Edgar W. Averill, Jr.

[57] ABSTRACT

An exerciser for softball pitchers who are especially strengthening the muscles in the shoulder and arm of the user. The exerciser has a base which may be attached to a fixed frame member. A rotatable arm is held by the base, and a brake pad and shoe assembly is affixed between the rotatable arm and the base. The amount of pressure between the brake pads and the brake shoe is adjustable. A curved arm is held by the arm-support member, and a flexible line is attached at its remote end. The flexible line is about one-half the length of the curved arm. The curved arm may be rotated 360° around the base.

7 Claims, 3 Drawing Sheets 10
12
13
14
15
18
19
20
22
24
25
26
27
28
29
30
31
32
33
34
35
36
37
38
39
40
41
42

EXERCISER FOR SOFTBALL PITCHERS

BACKGROUND OF THE INVENTION

The field of the invention is exercising devices, and the invention relates more particularly to devices for exercising the arm and shoulder of the user.

An almost unlimited number of exercising devices are known for strengthening the muscles of athletes in almost every sport. Unfortunately, most exercising devices are so expensive that they are only available to members of an exercising club or a large team. One example of an expensive exercising device is shown in the Sagedahl et al. Pat. No. 4,592,545. In FIGS. 23 and 24, it can be seen that a baseball 226 is attached to a straight length 206 to an arm 24. An exercising device that forces the user to move his hand in a fixed ark is shown in U.S. Pat. No. 4,772,015. For most sports, particularly for softball and baseball, the athlete's arm does not move in a circle or a part of a circle but, instead, in a complex arc. A wheel affixed about a vertical axis and having a leather strap secured around one of the yolks is shown in U.S. Pat. No. 2,245,027. Another exercising device for muscular rehabilitation is shown in U.S. Pat. No. 4,640,268. With the exception of U.S. Pat. No. 2,245,027, these devices are relatively expensive and impractical for the individual athlete's home use. For many sports, such as baseball and softball, it would be beneficial for the player to be able to exercise at home with an exercising device that is reasonable in cost and adjustable for different strengths, heights, ages, and for both males and females.

SUMMARY OF THE INVENTION

It is an object of the present invention to provide a low-cost exercising device for strengthening the shoulder, arm, fingers, wrists, chest, waist and legs of the user.

The present invention is for an exerciser for softball pitchers and other ball players for especially strengthening the muscles in the shoulder and arm of the user. The exerciser has a base which may be attached to a fixed frame member. A rotatable arm support member is rotatably affixed to the base. A brake pad and brake shoe assembly is affixed between the base and the rotatable arm support member. Means are provided for adjustably applying pressure between the brake pad and the brake shoes. A curved arm is affixed to the rotatable arm support member and is capable of movement 360° about the base member. A flexible line is affixed to the end of the curved arm and has a length of about one-half of that of the curved arm. An object such as a softball is affixed at the remote end of the flexible line.

DESCRIPTION OF THE PREFERRED EMBODIMENTS

Figure 1:
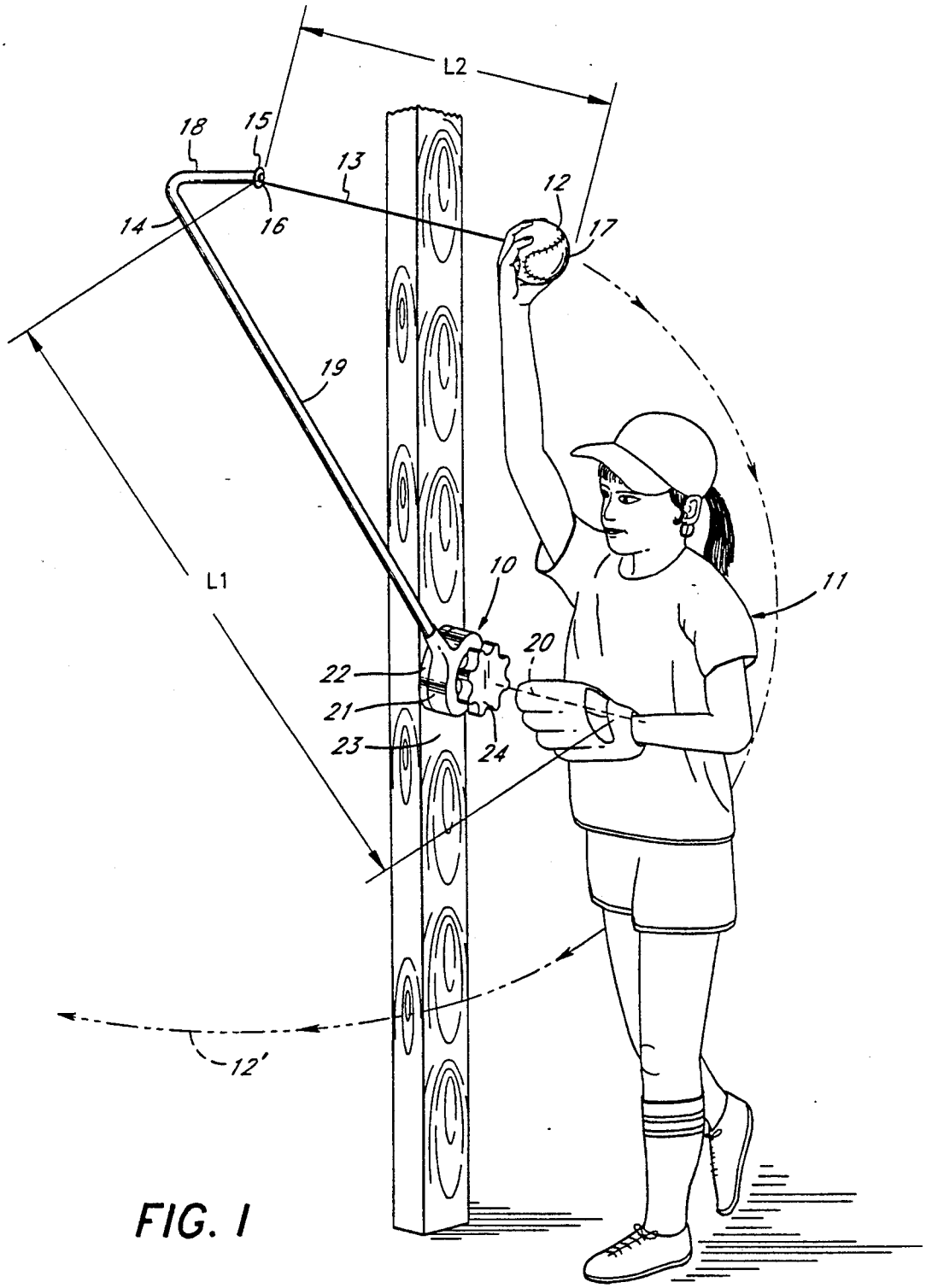
FIG. 1 is a perspective view of the exerciser of the present invention showing a user.

An exerciser for softball pitchers and other athletes who throw objects is shown in perspective view in FIG. 1 and indicated generally by reference character 10. The user 11 is grasping a softball 12 which is held by a flexible line I3 at the end of a curved arm 14. Curved arm 14 has a remote end 15 to which the first end 16 of flexible line 13 is attached. The second end 17 of flexible line 13 passes through softball 12, and flexible line 13 has a length L2. The curved arm has an outwardly curved portion 18 and moves upwardly along its length 19 and rotates about an axis of rotation 20 of a rotatable arm support member 21.

The rotatable arm support member 21 is rotatably affixed to a base 22. Base 22 is screwed, or otherwise affixed, to a frame member 23, as shown in more detail in FIG. 2. An adjustment knob 24 allows the user to increase or decrease the resistance to turning of the adjustable knob with respect to the base.

An important result of the assembly 10 is that the object, or ball 12, be moved in a free form curve such as curve 12′ since the flexible line 13 moves at various angles with respect to the length 19. This construction of a relatively long length L2 with respect to the length L1 permits this noncircular motion.

Figures 2, 3:
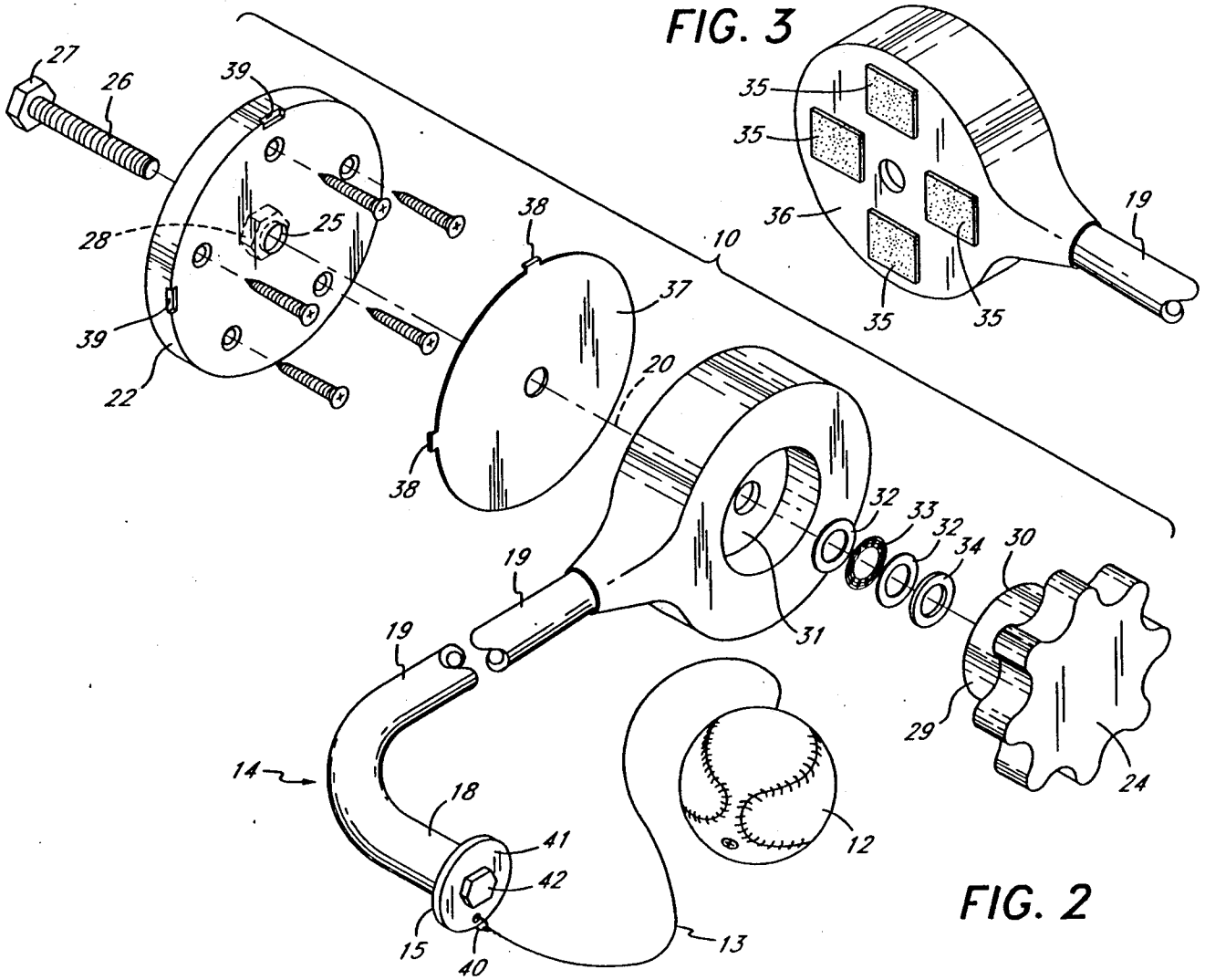
FIG. 2 is an exploded, perspective view partly broken away of the exerciser of FIG. 1.
FIG. 3 is a perspective view of the inner face of the rotatable arm support member of the exerciser of FIG. 1.

Turning now to FIG. 2, the internal construction of the device is shown. The base 22 has a central opening 25 through which a bolt 26 extends. The bolt head 27 fits into a hexagonal socket 28, and the threads of bolt 26 extend outwardly into threads at the center of adjustment knob assembly 29. Adjustment knob assembly 29 has an inner face 30 which presses against contact face 31 through a pair of washers 32 which surround a thrust bearing 33. A knob washer 34 completes the assembly between the inner face 30 and the contact face 31. Thus, by turning adjustment knob 24, the brake pads 35, which are attached to the support member inner face 36 are forced against brake shoe 37. Brake shoe 37 has a tab 38 which fits into a notch 39 in base 22 to prevent turning of brake shoe 37 with respect to base 22.

The object to be grasped, which is a softball 12 in FIGS. 1 and 2, is affixed to flexible line 13 by way of a swivel 40 which, in turn, is affixed to ring 41 which is held to the remote end 15 of curved arm 14. In this way, ball 12 may be turned and moved without creating any twist in line 13.

Figure 4A:
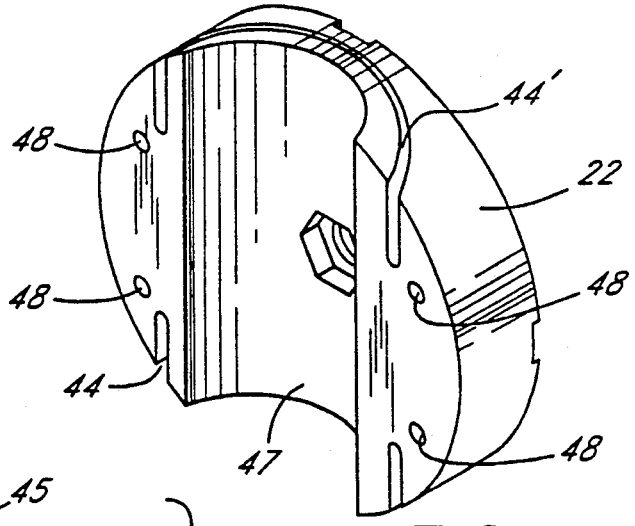
FIG. 4*a* is a perspective view of the inner face of the base of the exerciser of the present invention.
Figure 4:
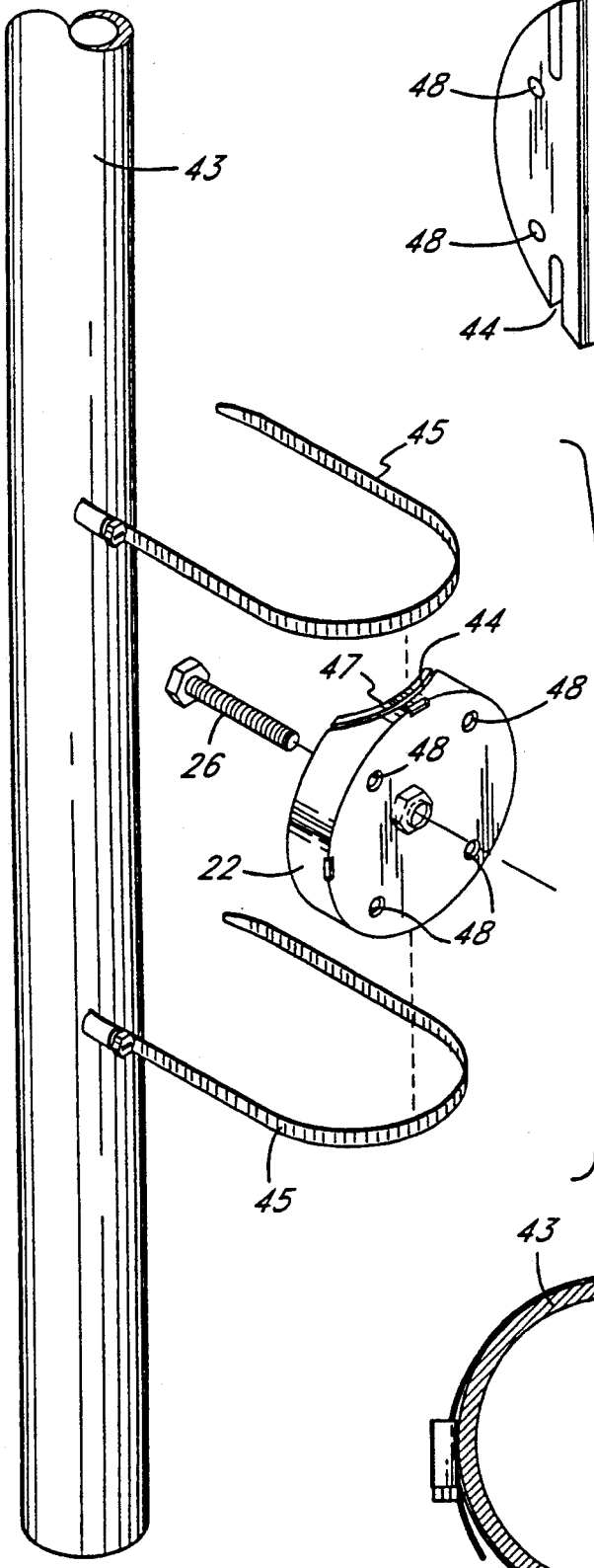
FIG. 4 is an exploded, perspective view of the clamp assembly for holding the base of the exerciser of FIG. 1 to a pole.
Figure 5:
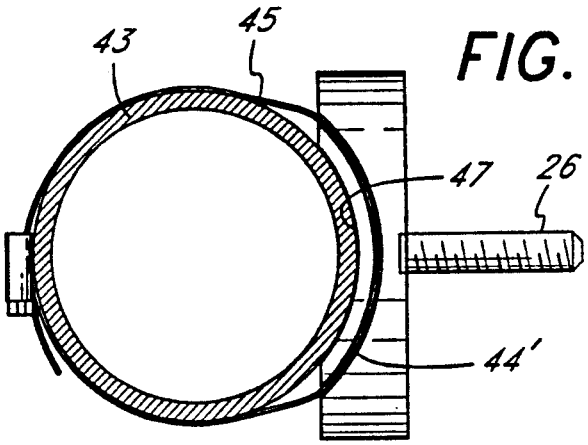
FIG. 5 is a cross-sectional top view of the base and clamp assembly of FIG. 4.

The exercising device of the present invention may be made relatively low in cost so that it can be purchased by individual athletes for use at home or at the ball field. As shown in FIGS. 4, 4*a* and 5, it is advantageous that the device be portable and attachable to various vertical frame members such as pipe 43 shown in FIGS. 4 and 5. Base 22 has two curved slots 44 and 44′ into which a pair of clamps 45 may be inserted. A curved depression 47 is formed adjacent to flat face 48. As shown in FIG. 5, the clamps encircle the portion of base 22 adjacent curved depression 47 and securely hold the base 22 to pipe 43. Four openings 48 may be used to secure the base to an object such as frame member 23 in FIG. 1.

It is important that flexible line 13 be of sufficient length as compared to the length of curved arm 14. The length of curved arm 14, indicated by "L1" in FIG. 1 is the shortest distance between the remote end 15 of curved arm 14 and the axis of rotation 20 of the rotatable arm support member 21. The length of the flexible line 13 is indicated by "L2" in FIG. 1, and L2 should be about one-half of L1. In this way, the ball may be moved in a natural pitching motion such as the windmill motion of a softball pitcher. Because of the relatively long length of L2, the user's natural motion is not interfered with by the rigid arm 14. As the user's strength increases, the device may be easily adjusted to add additional resistance to turning. While the present invention has been discussed with respect to softball pitching, it, of course, is useful for any ball-throwing athlete. For instance, it can be used to exercise an overhand-throwing baseball pitcher and also can be used either bY a left-handed person or a right-handed person. The essential characteristic is that the ball, or other object to be grasped, is not required to move in the arc of a circle but is free to move in the natural motion of the athlete. Thus, when the term "softball pitchers" is used in the claims, it is intended to cover any object-throwing athlete. While the flexible line 13 is preferably monofilament nylon, other materials can be used such as plastic-coated steel cable.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An exerciser for softball pitchers for especially strengthening the muscles in the shoulder and arm of the user, said exerciser comprising:

a base attachable to a fixed frame member;

a rotatable arm support member rotatably affixed to said base;

a brake pad and brake shoe affixed between said base and said rotatable arm support member;

means for adjustably applying pressure between said brake pad and brake shoe;

a curved arm affixed to said rotatable arm support member, said curved arm extending upwardly and outwardly away from said base, said curved arm capable of movement 360° about said base, and said curved arm having a remote end;

a flexible line having a first end and a second end and having its first end affixed to said remote end of said curved arm; and an object to be grasped affixed to the second end of said flexible line.

2. The exerciser for softball pitchers of claim 1 wherein said object to be grasped is a ball.

3. The exerciser for softball pitchers of claim 2 wherein said ball is a softball.

4. The exerciser for softball pitchers of claim 1 wherein the length of said flexible line is about one-half the distance from the remote end of the curved arm and the center of rotation of the rotatable arm support member.

5. An exerciser for softball pitchers for especially strengthening the muscles in the shoulder and arm of the user, said exerciser comprising:

a rotatable arm support member rotatably affixed to said base and rotating about an axis of rotation;

a brake pad and brake shoe affixed between said base and said rotatable arm support member; pad and brake shoe;

a curved arm affixed to said rotatable arm support member, said curved arm extending upwardly and outwardly away from said base, said curved arm capable of movement 360° about said base, and said curved arm having a remote end which is at a first length from the axis of rotation of said rotatable arm support member;

a flexible line having a first end and a second end and having its first end affixed to said remote end of said curved arm and having a flexible line length equal to about one-half of the first length of said curved arm; and an object to be grasped affixed to the second end of said flexible line.

6. The exerciser for softball pitchers of claim 5 wherein said flexible line is a nylon monofilament line.

7. The exerciser for softball pitchers of claim 5 wherein said base has clamp slots for affixing the base to a vertical pipe.

* * * * *